US007075426B2

(12) United States Patent
Johnson et al.

(10) Patent No.: US 7,075,426 B2
(45) Date of Patent: Jul. 11, 2006

(54) FLEX MOTION WAKE-UP CIRCUIT FOR A SECURITY PACK

(75) Inventors: Ray Johnson, Bonaire, GA (US); Mark Oudshoorn, Parish, FL (US); Joel Bartholf, Macon, GA (US)

(73) Assignee: 3SI Security Systems, Inc., Exton, PA (US)

( * ) Notice: Subject to any disclaimer, the term of this patent is extended or adjusted under 35 U.S.C. 154(b) by 125 days.

(21) Appl. No.: 10/656,519

(22) Filed: Sep. 5, 2003

(65) Prior Publication Data

US 2004/0080416 A1 Apr. 29, 2004

Related U.S. Application Data

(60) Provisional application No. 60/408,650, filed on Sep. 6, 2002.

(51) Int. Cl.
*G08B 1/08* (2006.01)

(52) U.S. Cl. ..... 340/539.1; 340/568.1; 340/568.7

(58) Field of Classification Search ..... 340/539.1, 340/568.7, 568.1, 572.1; 310/330, 331, 311; 116/211, 214
See application file for complete search history.

(56) References Cited

U.S. PATENT DOCUMENTS

| | | | | |
|---|---|---|---|---|
| 3,303,592 A | | 2/1967 | Harner | 42/1 |
| 3,424,122 A | | 1/1969 | De Angelis | 116/2 |
| 3,828,341 A | * | 8/1974 | Carter et al. | 340/568.7 |
| 4,190,785 A | | 2/1980 | Kompanek | 310/330 |
| 4,559,529 A | * | 12/1985 | Bernhardt | 340/571 |
| 4,562,315 A | | 12/1985 | Aufderheide | 200/5 A |
| 4,585,970 A | | 4/1986 | Koal et al. | 310/331 |
| 4,604,607 A | * | 8/1986 | Sanderford et al. | 340/539.1 |
| 4,639,716 A | | 1/1987 | Payne | 340/571 |
| 5,051,605 A | | 9/1991 | D'Antonio et al. | 307/116 |
| 5,059,949 A | | 10/1991 | Caparoni et al. | 340/571 |
| 5,157,372 A | | 10/1992 | Langford | 338/211 |
| 5,196,828 A | | 3/1993 | Keniston | 340/571 |
| 5,288,551 A | | 2/1994 | Sato et al. | 428/334 |
| 5,485,143 A | | 1/1996 | Keniston | 340/568 |
| 5,568,157 A | | 10/1996 | Anderson | 343/713 |
| 5,770,914 A | | 6/1998 | Pease et al. | 310/339 |
| 6,040,542 A | | 3/2000 | Wolfe | 200/512 |
| 6,104,119 A | | 8/2000 | Guzik et al. | 310/311 |
| 6,552,660 B1 | * | 4/2003 | Lisowski | 340/568.7 |
| 2003/0184438 A1 | * | 10/2003 | Williams et al. | 340/545.2 |

* cited by examiner

*Primary Examiner*—Phung T. Nguyen
(74) *Attorney, Agent, or Firm*—RatnerPrestia

(57) ABSTRACT

A wake-up circuit and associated method for use in an alarm system hidden in a currency resembling security pack. The alarm system includes an alarm device and an electronic alarm activation circuit that actuates the alarm device upon receipt of an alarm actuation signal. The wake up circuit includes a flexure sensor used to detect flexure of the security pack and upon sensing such flexure to switch the electronic alarm activation circuit from a first, dormant state to a second, active state.

14 Claims, 1 Drawing Sheet

FLEX MOTION WAKE-UP CIRCUIT FOR A SECURITY PACK

CROSS REFERENCE TO RELATED APPLICATIONS

This application claims the benefit of priority to U.S. Provisional Application No. 60/408,650, filed on Sep. 6, 2002, the contents of which are incorporated herein by reference in their entirety.

FIELD OF THE INVENTION

The present invention relates to security systems employing currency packs disguised as bundles of currency bills for discharging tear gas, dye, smoke and/or other chemicals in the event of a robbery and more particularly to an activation system using a flexure detecting sensor for switching such packs from a first, inactive state to a second, active state.

DESCRIPTION OF THE PRIOR ART

Among the devices which have been used by banks and other financial institutions to deter bank robberies, and to aid in the apprehension of a thief and the recovery of stolen monies, are security dye packs disguised as a strapped bundle of currency bills. Such security dye packs are normally kept in a teller drawer along with actual currency bills and are handed to a robber by the teller during a bank robbery. The top and bottom faces of the security dye pack are concealed by actual currency bills to simulate actual bundles of currency bills.

The disguised security dye packs actually conceal canisters containing tear gas, dye, smoke and/or other active chemicals which can be discharged from the security dye pack to assist in the recovery of stolen monies and to assist in the apprehension of an assailant. Typically such packs include electronic circuitry adapted to activate the release of the chemicals when certain conditions are met.

Recently, flexible security packs have been developed that better simulate actual money packs by permitting flexing of the security pack into a U-shape. Examples of such packs are shown in U.S. Pat. Nos. 5,196,828 and 5,485,143 both issued to Keniston, the contents of which are incorporated herein.

Several methods have been used to actuate such security dye packs upon unauthorized removal from protected premises. For example, some security dye packs are normally kept in the teller drawer on a magnetic keeper plate. A magnetic reed switch within the security dye pack disables the unit from detonating so long as the reed switch is within the influence of the magnetic field of the keeper plate. Once removed from the keeper plate, a timer is activated, and when the timer has reached a predetermined count, the canisters are actuated to deploy the active chemical agents.

Another variety of such security dye packs includes a plug anchored by a pull wire to the teller drawer; removal of the security dye pack from the teller drawer causes the plug to be removed from the unit, thereby arming the device. Such security dye packs are generally described, for example, within U.S. Pat. No. 3,303,592 issued to Harner, and within U.S. Pat. No. 3,424,122 issued to De Angelis.

More sophisticated security dye packs contain miniature radio receivers which are tuned to receive a localized radio signal broadcast by an antenna in the vicinity of the entry doors to the bank. The transmitted signal is limited to the vicinity of the doors and does not normally extend to the teller area. If a security dye pack is handed to a robber and is thereafter brought into the field of the broadcast radio signal, the transmitted signal is detected by the radio receiver to arm the security dye pack. The security dye pack may then immediately be detonated, or a time delay circuit can hold off detonation of the chemical canisters for a predetermined amount of time to permit the robber to first exit the premises. Modern security dye packs often include a hold-off circuit preventing the security dye pack from being detonated until the robber has left the field of the transmitted signal. In addition, modern security systems often employ digital coding techniques to minimize the likelihood of inadvertent detonation due to stray radio signals generated by other electronic equipment within the banking environment. An Examples of such radio-activated security dye packs and associated system is described within U.S. Pat. No. 4,639,716 issued to Payne on Jan. 27, 1987 and incorporated herein by reference.

In summary, security packs today almost invariably include primary electronic circuitry designed to receive an activation signal to initiate the ignition of the chemicals and electronic wake-up circuitry designed to remove the primary circuitry from a standby condition in which the circuitry is in effect turned off and insensitive to the activation signal, to an active condition where the primary electronic circuit is sensitive to the activation signal.

Typically the wake up circuitry most commonly used is a mercury type switch that is sensitive to motion, or a reed switch held to an open position by a magnetic plate on which the security pack is kept. Both such methods are susceptible to inadvertent actuation of the "wake-up" circuit as a result of slight nudging of the pack in the drawer, or inadvertent removal of the pack from the magnetic receptacle. While most activation systems will return to the standby position after a minute or two unless they subsequently receive an activation signal, such wake-up cycling results in premature discharge of the battery powering the security pack electronics. There is, therefore, still a need for a better wake-up system that is less sensitive to inadvertent motion or displacement from a prescribed location to prevent unintended wake-up cycling of the electronics and the resulting battery discharge.

SUMMARY OF THE INVENTION

According to this invention there is provided a wake-up circuit for use in a flexible security pack comprising an electronic activation system to switch the electronic activation system from a first, dormant state to a second, active state. The wake up circuit comprises a transducer sensitive to flexure of the security pack, for generating an output signal. The transducer is connected to an electrical switching circuit adapted to switch the electronic activation circuit from the first, dormant state to the second, active state.

The transducer may be any type of sensor that detects flexure, including variable resistor type transducers, membrane switches including flexible capacitive switches, flexible piezoelectric transducers or mechanical switches that provide a contact closure or opening when flexed, as are well known in the art. Preferably, the transducer is placed near the center of the flexible security pack, at the point of maximum flexing.

Another aspect of this invention is providing a piezoelectric transducer or other flexure sensitive element in a security pack positioned so as to provide an output signal when pressure or flexure is applied to the security pack and applying the output signal to switch an electronic alarm circuit from a first, dormant state to a second, active state.

BRIEF DESCRIPTION OF THE DRAWINGS

The invention is best understood from the following detailed description when read in connection with the accompanying drawing. It is emphasized that, according to common practice, the various features of the drawing are not to scale. On the contrary, the dimensions of the various features are arbitrarily expanded or reduced for clarity. Included in the drawing are the following figures.

DETAILED DESCRIPTION OF THE INVENTION

The invention will next be described with reference to the figures wherein same numerals are used to identify same elements in all figures. The figures illustrate the invention and are not intended to act as engineering or construction drawings, therefore they are not to scale and do not include all elements that may be included in such drawings, as inclusion of such elements would unduly clutter the drawings.

Figure 1:
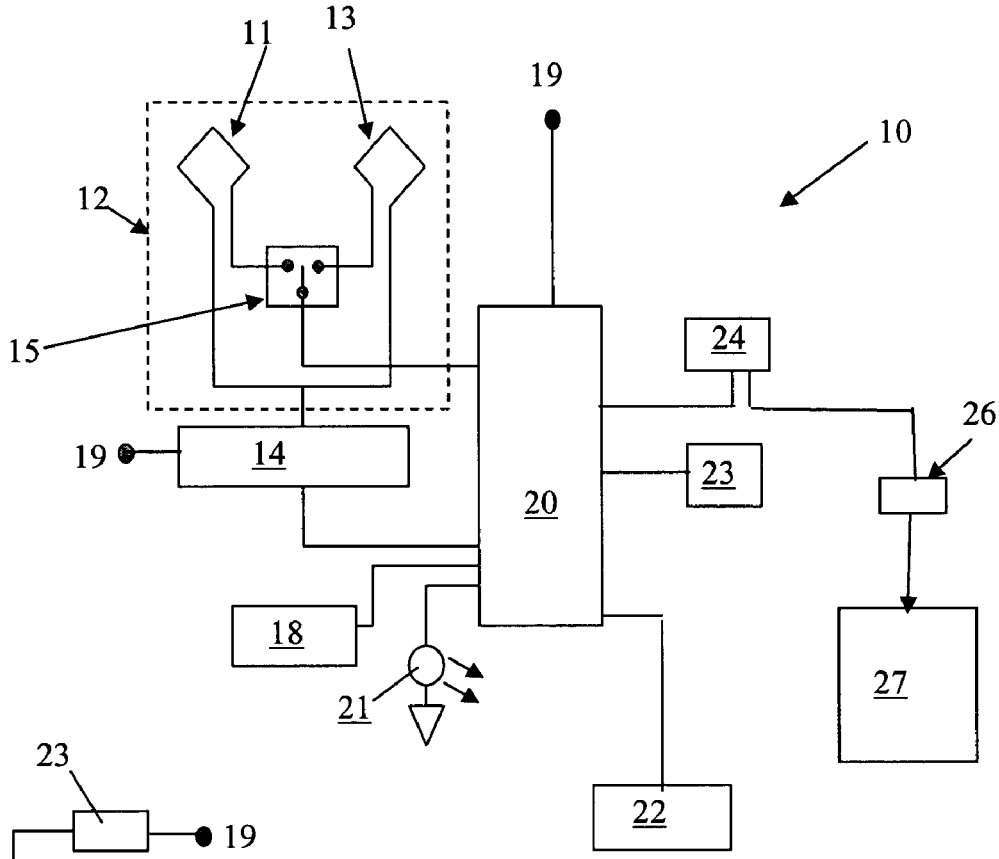
FIG. 1 shows a block diagram representation of a typical electronic alarm circuit according to this invention.

FIG. 1 shows the main elements of the electronic circuitry used in a security packet modified in accordance with this invention. Such electronic circuitry 10 may comprise a microprocessor 20 to control a number of functions necessary to activate the alarm and ignite the smoke generator or other alarm means used to deter the theft. An antenna system 12 connected to a front end RF detector 14 is used for detecting the presence of an activation field signal.

The above referred to U.S. Pat. No. 4,639,716 issued to Payne, discloses a security alarm system in which a security packet alarm circuit is activated after passage through a Radio Frequency (RF) field.

In one embodiment of the present invention, it is contemplated that detection of the radio frequency, RF, signal may be done by alternately tuning to different frequencies using the same circuitry and the same antennas, rather than detecting an RF field to arm the device and a second RF field to disarm it. See also U.S. Pat. No. 5,568,157 issued to Anderson and incorporated herein by reference.

In a preferred embodiment according to this invention, two orthogonal antenna coils 11 and 13 are used alternately tuned to one of two different frequencies and the output of the coils is sampled 15 to determine if a signal is detected at the tuned frequency. The result is superior sensing of both frequencies in two orthogonal planes.

A crystal oscillator 18 may be present to provide the needed operating signal to the microprocessor as is well known in the art. An indicator 21 may be present to indicate proper functioning of the alarm system. Also present are a power supply not shown such as a battery, a charging circuit 24 controlled by the microprocessor for developing sufficient voltage to ignite the igniters 26 that ignite the smoke generator or other deterrent device 27. The microprocessor may include a time delay circuit to delay ignition of the igniters 26 in order to avoid alerting the robbers while still in the bank. A reset circuit 23 may also be provided to reset the microprocessor to a standby condition following detection of certain predetermined events. Power may be supplied to the different components through connections 19.

According to this invention a flexure sensor 22 outputs a signal to microprocessor 20. This signal is used by the microprocessor 20 to switch the electronic circuit 10 from a first, dormant state to a second active state in which the electronics may receive and recognize an alarm activation signal and ignite the igniters or start whatever other alarm means are used as the deterrent device.

The flexure sensor 22 may comprise a switch comprising a strip of a variable resistance material. The resistance of the resistance element varies as a function of the bending of the strip. The resistance material is, typically electrically connected to a detector circuit, such as the microprocessor 20 in FIG. 1. The microprocessor detects the electrical condition of resistance of the resistance material and turns a switching circuit ON/OFF depending on predetermined values. Alternatively, the flexure sensor may be a flexible capacitive switch, a flexible conventional contact switch or any other switch device operable to change states upon movement flexure. A variety of flexure sensitive detectors and membrane switches are well known in the art as shown in U.S. Pat. No. 4,562,315 issued in 1985 to Aufderheide, or U.S. Pat. No. 5,157,372 issued in 1992 to Langford.

Figure 3:
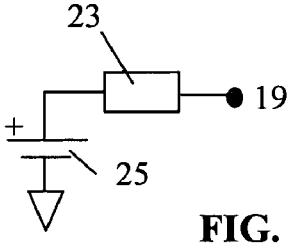
FIG. 3 shows a circuit wherein the flexure sensitive element is a switch placed between a power source and an input to a electronic alarm circuit.

In a preferred embodiment the flexure sensor 22 comprises a piezoelectric transducer. The piezoelectric transducer is in the form of a thin flexible strip of piezoelectric material which produces an output voltage as a function of flexing the transducer. Thin flexible piezoelectric materials are also well known in the art. U.S. Pat. No. 5,288,551 issued to Sato et al. and U.S. Pat. No. 4,190,785 issue to Kompanek, both disclose such materials. Images SI, Inc. a United States company advertises piezoelectric film strips of a type useful for application in this invention. See www.imagesco.com/catalog/sensors/film.html Another electronic circuit for detecting the removal of the security dye pack from the premises and for discharging the dye, smoke or teargas is shown in the aforementioned U.S. Pat. No. 5,196,828 to Keniston. When using the type of circuit disclosed in Keniston, the battery switch 276 in FIG. 11 by Keniston is replaced with a flexure sensitive switch of the type described above, in accordance with this invention. FIG. 3 shows a battery source 25 connected through a flexure sensitive switch 23 to an input 19 of an alarm activation circuit (not shown). In a preferred embodiment the switch is a flexible piezoelectric switch. Such switches are also well known in the art, as exemplified by U.S. Pat. Nos. 4,585,970 and 6,104,119. Piezoelectric switches are commercially available from a number of sources including Images SI, Inc. referred to above.

U.S. Pat. No. 5,059,949 issued in 1991 to Caparoni et al. and incorporated herein by reference, shows a security pack or currency alarm pack using multiple circuit boards to mount the various electronic components of the alarm circuit positioned on a flexible substrate having printed conductors interconnecting the individual PC boards. This permits the package to flex as shown in FIG. 3 of the Caparoni et al. reference.

The Keniston patent discloses a security dye pack disguised as a bundle of currency for deterring robberies. The disclosed packet includes a housing formed from a stack of currency bills sewn together and having a hallow chamber formed therein. A substrate disposed within the chamber has a flexible central region through which electrical conductors extend for making electrical interconnections between opposing ends of the substrate.

Electrical components are mounted on both sides of the flexible central region to generate an actuating signal upon detecting removal of the security dye pack from the protected premises. Canisters containing dye or other active chemicals are secured at opposing ends of the substrate to emit dyed or other active chemicals in opposing directions when expended. The flexible central region of the substrate allows the security dye pack to be bent into a U-shape. Batteries are arranged in a side-by-side relationship in an elongated narrow case to facilitate bending of the security dye pack.

Figure 2:
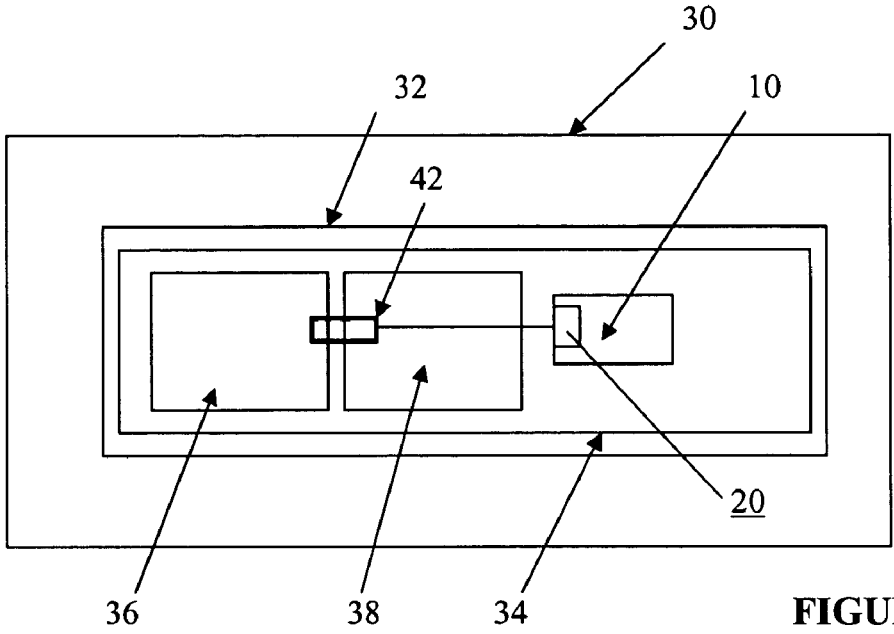
FIG. 2 is a schematic plan view of a security pack according to this invention.

As shown in FIG. 2, a security pack 30 resembling a stack of currency, has a cavity 32 formed therein. Within the cavity there is placed a flexible printed circuit board 34 on which there is mounted a first and second smoke generator 36 and 38 respectively, and a conventional detector electronic circuit 10 such as described above. The piezoelectric sensor transducer 42 is preferably mounted bridging the flex point between smoke generator 36 and smoke generator 38. Thus, as the security pack is removed and flexed while placed in a container with other packs of real money, the transducer generates an output voltage which is used to bias a transistor which outputs an interrupt signal to the microprocessor 20 upon detection of a voltage over a predetermined value.

In an embodiment comprising flexible security packs such as shown in the Caparoni et al. or Keniston patents above, the flexible piezoelectric transducer is placed preferably bridging electronic components of the alarm circuit. It is desirable that the transducer be placed bridging the flexure line of the pack, usually in the center of the security pack where maximum bending occurs.

Although the invention is illustrated and described herein with reference to specific embodiments, the invention is not intended to be limited to the details shown. Rather, various modifications may be made in the details within the scope and range of equivalents of the claims and without departing from the invention.

What we claim is:

1. A wake-up circuit for use in a security pack resembling a currency pack said wake up circuit comprising an alarm device and an electronic activation circuit for said alarm device, wherein said wake up circuit comprises a flexure sensor positioned in said security pack so that said flexure sensor flexes when said currency pack is flexed, said wake up circuit being adapted to switch the electronic alarm activation circuit from a first, dormant state to a second, active state when said currency pack is flexed.

2. The wake up circuit of claim 1 wherein said electronic activation circuit comprises a microprocessor, wherein said flexure sensor is connected to said microprocessor and wherein an output signal from said sensor received by said microprocessor switches the electronic alarm activation circuit from said first, dormant state to said second, active state.

3. The wake up circuit of claim 1, wherein said sensor comprises a flexure sensing transducer and wherein said transducer is a piezoelectric transducer.

4. The wake up circuit of claim 1, wherein said sensor comprises a flexure sensing transducer and wherein said transducer is a variable resistive element.

5. The wake up circuit of claim 1, wherein said sensor comprises a flexure sensing transducer and wherein said transducer is a capacitive element.

6. A wake-up circuit for use in a security pack resembling a currency pack comprising an alarm device and an electronic activation circuit for said alarm device in a packet resembling a currency pack, wherein said wake up circuit comprises a flexure sensor adapted to switch the electronic alarm activation circuit from a first, dormant state to a second, active state, said security pack comprises at least two printed circuit boards with discreet electronic components thereon, said electronic activation circuit comprises a microprocessor, said flexure sensor is connected to said microprocessor and an output signal from said sensor received by said microprocessor switches the electronic alarm activation circuit from said first, dormant state to said second, active state and wherein said sensor comprises a flexure sensing transducer and said transducer is positioned straddling more than one of said boards.

7. The wake up circuit of claim 6, wherein said transducer is flexible.

8. The wake up circuit of claim 6, wherein said transducer is a piezoelectric transducer.

9. A wake-up circuit for use in a security pack resembling a currency pack comprising an alarm device and an electronic activation circuit for said alarm device in a packet resembling a currency pack, wherein said wake up circuit comprises a flexure sensor adapted to switch the electronic alarm activation circuit from a first, dormant state to a second, active state, said security pack comprises a flexible printed circuit with a plurality of discreet electronic components and wherein said sensor comprises a flexure sensing transducer and said transducer is positioned straddling more than one of said discreet components.

10. The wake up circuit of claim 9 wherein said security pack includes a power source and wherein said sensor comprises a switch connected between said power source and said electronic alarm activation circuit.

11. A method for waking up a security pack comprising an alarm device and an electronic activation circuit for said alarm device in a flexible packet resembling a currency pack, wherein said wake up circuit comprises a flexure sensor positioned in said security pack so as to flex when said security packet is flexed and generate an output signal indicative of said flexure, said signal adapted to switch the electronic alarm activation circuit from a first, dormant state to a second, active state, the method comprising waking up said alarm device only as a result of flexing the security pack.

12. A method for switching an electronic activation circuit for an alarm device contained in a flexible currency resembling security pack the method from a standby state to an active state, the method comprising:

(a) placing a flexure sensor within said security pack in a position such that said flexure sensor flexes when said packase is flexed;

(b) sensing a package flexure with said sensor;

(c) generating a signal indicative of said package flexure;

(d) applying said signal to switch said electronic activation circuit for said alarm device from said standby state to said active state.

13. The method of claim 12 wherein said step of applying said signal to switch said electronic activation circuit to said active state further comprises connecting an output of a power source to an input of said electronic activation circuit.

14. The method according to claim 12 wherein said step of placing said flexure sensor within said security package comprises positioning said sensor across at least two distinct electronic components or boards comprising electronic components.

* * * * *